US011471367B2

(12) United States Patent
Orgill et al.

(10) Patent No.: US 11,471,367 B2
(45) Date of Patent: Oct. 18, 2022

(54) SYSTEMS AND METHODS FOR PROMOTION OF ANGIOGENESIS AND ADIPOGENESIS IN TISSUES THROUGH APPLICATION OF MECHANICAL FORCES

(71) Applicant: Brigham and Women's Hospital, Inc., Boston, MA (US)

(72) Inventors: Dennis Paul Orgill, Belmont, MA (US); Luca Lancerotto, Padua (IT); Giorgio Giatsidis, Bareggio (IT)

(73) Assignee: The Brigham and Women's Hospital, Inc., Boston, MA (US)

( * ) Notice: Subject to any disclaimer, the term of this patent is extended or adjusted under 35 U.S.C. 154(b) by 1058 days.

(21) Appl. No.: 15/550,092

(22) PCT Filed: Feb. 17, 2016

(86) PCT No.: PCT/US2016/018164

§ 371 (c)(1),
(2) Date: Aug. 10, 2017

(87) PCT Pub. No.: WO2016/133957

PCT Pub. Date: Aug. 25, 2016

(65) Prior Publication Data

US 2018/0021209 A1 Jan. 25, 2018

Related U.S. Application Data

(60) Provisional application No. 62/117,011, filed on Feb. 17, 2015.

(51) Int. Cl.
*A61H 9/00* (2006.01)

(52) U.S. Cl.
CPC ... *A61H 9/0057* (2013.01); *A61H 2201/5061* (2013.01); *A61H 2201/5071* (2013.01);
(Continued)

(58) Field of Classification Search
CPC ..... A61H 9/0057; A61H 2201/5061; A61H 2201/5071; A61H 2201/5092;
(Continued)

(56) References Cited

U.S. PATENT DOCUMENTS 936,434 A 10/1909 Eganhouse
5,676,634 A 10/1997 Khouri
(Continued)

FOREIGN PATENT DOCUMENTS

CA 2827067 8/2012
WO 2007124478 11/2007

OTHER PUBLICATIONS

Pietramaggiori et al.; Tensile Forces Stimulate Vascular Remodeling and Epidermal Cell Proliferation in Living Skin; Nov. 2007; Annals of Surgery; vol. 246, No. 5; p. 896-902 (Year: 2007).*
(Continued)

*Primary Examiner* — Joseph D. Boecker
*Assistant Examiner* — Brian T Khong
(74) *Attorney, Agent, or Firm* — Quarles & Brady LLP

(57) ABSTRACT

A system and method for promoting angiogenesis and adipogenesis in soft tissue using a tissue enlargement apparatus. The tissue enlargement apparatus includes an interface configured for affixation to the soft tissue. A force generating device is coupled to the interface by a connecting tube for applying mechanical forces to the soft tissue. A processor is coupled to the force generating device and is configured to apply intermittent cyclical patterns of the mechanical forces to the soft tissue to promote angiogenesis and adipogenesis in soft tissue. The intermittent cyclical patterns are based on at least one of duration, frequency, and intensity of the mechanical forces.

20 Claims, 5 Drawing Sheets

(52) U.S. Cl.
CPC ..... *A61H 2201/5092* (2013.01); *A61H 2230/206* (2013.01); *A61H 2230/208* (2013.01); *A61H 2230/505* (2013.01)

(58) Field of Classification Search
CPC ..... A61H 2230/206; A61H 2230/208; A61H 2230/505; A61H 9/005; A61H 2009/0064; A61H 7/008; A61M 1/75; A61M 1/90; A61M 1/91; A61M 1/912; A61M 1/913; A61M 1/915; A61M 1/916; A61M 1/917; A61M 1/918; A61M 1/96
See application file for complete search history.

(56) References Cited

U.S. PATENT DOCUMENTS

| | | | | |
|---|---|---|---|---|
| 5,701,917 | A | 12/1997 | Khouri | |
| 6,030,318 | A * | 2/2000 | Howard | A61H 9/005 482/4 |
| 6,042,537 | A | 3/2000 | Kaiser | |
| 6,478,656 | B1 | 11/2002 | Khouri | |
| 6,641,527 | B2 | 11/2003 | Khouri | |
| 6,699,176 | B1 | 3/2004 | Khouri | |
| 6,936,037 | B2 | 8/2005 | Bubb | |
| 6,951,553 | B2 | 10/2005 | Bubb | |
| 7,494,482 | B2 * | 2/2009 | Orgill | A61L 15/42 424/423 |
| 7,907,766 | B2 | 3/2011 | Lehel | |
| 7,970,196 | B2 | 6/2011 | Arnold | |
| 8,066,691 | B2 | 11/2011 | Khouri | |
| 8,121,696 | B2 * | 2/2012 | Vallero | A61M 5/422 607/46 |
| 8,605,979 | B2 | 12/2013 | Arnold | |
| 8,718,342 | B2 | 5/2014 | Bernhardt | |
| 8,867,822 | B2 | 10/2014 | Oh | |
| 8,915,894 | B1 * | 12/2014 | Lonky | A61M 37/00 604/289 |
| 8,970,578 | B2 | 3/2015 | Voros | |
| 2003/0108587 | A1 | 6/2003 | Orgill | |
| 2006/0013460 | A1 | 1/2006 | Dehmeshki | |
| 2007/0208281 | A1 * | 9/2007 | Brooks | A61M 1/08 601/6 |
| 2009/0312746 | A1 | 12/2009 | Khouri | |
| 2011/0060204 | A1 * | 3/2011 | Weston | A61M 1/75 604/319 |
| 2011/0224542 | A1 | 3/2011 | Mittal | |
| 2011/0092958 | A1 * | 4/2011 | Jacobs | A61M 1/90 604/543 |
| 2011/0243412 | A1 | 10/2011 | Grass | |

OTHER PUBLICATIONS

Ross, RJ., et al., Autologous fat grafting: current state of the art and critical review. Ann Plast. Surg. Sep. 2014.

Kling, R.E., et al., Trends in autologous fat grafting to the breast: a national survey of the American Society of Plastic Surgeons. Platsic Reconstr Surg. Jul. 2013;132(1):35-46.

Del Vecchio, D. et al., A classification of clinical fat grafting: different problems, different solutions. Plast Reconstr Surg. Sep. 2012;130(3):511-22.

Scherer, S.S., et al., Wound healing kinetics of the genetically diabetic mouse. Wounds. Jan. 2008;20(1):18-28.

Jia, Y., et al., Studies in Fat Grafling: Part I. Effects of Injection Technique on In Vitro Fat Viability and In Vivo Volume Retention; and Studies in Fat Grafting: Part II. Effects of Injection Mechanics on Material Properties of Fat. Plast Reconstr Surg. Feb. 2015;135(2):446e-7e.

Geissler, P.J., et al., Improving fat transfer viability: the role of aging, body mass index, and harvest site. Plast Reconstr Surg. Aug. 2014;134(2):227-32.

Salinas H.M., et al., Comparative analysis of processing methods in fat grafting. Plast Reconstr Surg. Oct. 2014;134(4):675-83.

Gir, P., et al., Fat grafting: evidence-based review on autologous fat harvesting, processing, reinjection, and storage. Plast Reconstr Surg. Jul. 2012;130(1):249-58.

Lequeux, C., et al., Subcutaneous fat tissue engineering using autologous adipose-derived stem cells seeded onto a collagen scaffold. Plast Reconstr Surg. Dec. 2012;130(6):1208-17.

Del Vecchio, D.A. et al., The graft-to-capacity ratio: volumetric planning in large-volume fat transplantation. Plast Reconstr Surg. Mar. 2014;133(3):561-9.

Dong, Z., et al., The angiogenic and adipogenic modes of adipose tissue after free fat grafting. Plast Reconstr Surg. Mar. 2015;135(3):556e-67e.

Khouri, R., et al., Breast reconstruction and augmentation using pre-expansion and autologous fat transplantation. Clin Plast Surg. Apr. 2009;36(2):269-80.

Freshwater, M.F., et al., Will the bra cup's contents remain 60 percent full, 40 percent empty, or develop microcalcifications? The need for long-term independent studies of Brava and fat grafting. Plast Reconstr Surg. Jan. 2012;129(1):172e.

Giatsidis, G., et al., Moderate-intensity Intermittent External Volume Expansion Optimizes the Soft Tissue Response in a Murine Model Plast Reconstr Surg. Apr. 2017.

Thanik, V.D., et al. A murine model for studying diffusely injected human fat. Plast Reconstr Surg. Jul. 2009;124(1):74-81.

Wang, W.Z., et al. Analysis for apoptosis and necrosis on adipocytes, stromal vascular fraction, and adipose-derived stem cells in human lipoaspirates after liposuction. Plast Reconstr Surg. Jan. 2013;131(1):77e-85e.

Schlenz, I., et al., The Brava external tissue expander: is breast enlargement without surgery a reality? Plast Reconstr Surg. Nov. 2007;120(6):1680-9.

Heit, Y.I., et al. External volume expansion increases subcutaneous thickness, cell proliferation, and vascular remodeling in a murine model. Plast Reconstr Surg. Sep. 2012;130(3):541-7.

Lujan-Hernandez, J., et al., Induction of Adipogenesis by External Volume Expansion. Plast Reconstr Surg Jan. 2016;137(1):122-31.

Khouri, R.K., et al., Percentage augmentation: the more meaningful index of success in fat grafting. Plast Reconstr Surg. May 2015;135(5):933e-935e.

Scherer, S.S., et al., Short periodic applications of the vacuum assisted closure device cause an extended tissue response in the diabetic mouse model. Plast Reconstr Surg. Nov. 2009;124(5):1458-65.

Scherer, S.S., et al., The mechanism of action of the vacuum-assisted closure device. Plast Reconstr Surg. Sep. 2008;122(3):786-97.

Dastouri, P., et al., Waveform modulation of negative-pressure wound therapy in the murine model. Plast Reconstr Surg. Apr. 2011;127(4):1460-6.

Glotzbach, J.P., et al., The basic science of vascular biology: implications for the practicing surgeon. Plast Reconstr Surg. Nov. 2010;126(5):1528-38.

Akhavani, M.A., et al., Angiogenesis and plastic surgery. J Plast Reconstr Aesthet Surg. Dec. 2008;61(12):1425-37.

Adanali, G., et al., Early and late effects of ischemic preconditioning on microcirculation of skeletal muscle flaps. Plast Reconstr Surg. Apr. 1, 2002;109(4):1344-51.

Ho Quoc, C., et al., Tolerance of pre-expansion BRAVA and fat grafting into the breast. Ann Chir Plast Esthet. Jun. 2013;58(3):216-21. (With English Summary).

Ahmed, W. et al., "Automatic Detection and Quantification of the Agatston Coronary Artery Calcium Score on Contrast Computed Tomography Angiography." The International Journal of Cardiovascular Imaging 31, No. 1 (Jan. 2015): 151-61.

Isgum, I, et al., "Detection of Coronary Calcifications from Computed Tomography Scans for Automated Risk Assessment of Coronary Artery Disease." Medical Physics 34, No. 4 (Apr. 1, 2007): 1450-61.

Wolterink, J., et al., "Automatic Coronary Calcium Scoring in Non-Contrast-Enhanced ECG-Triggered Cardiac CT With Ambiguity Detection." IEEE Transactions on Medical Imaging 34, No. 9 (Sep. 2015): 1867-78.

(56) References Cited

OTHER PUBLICATIONS

Alluri, K., et al., "Scoring of Coronary Artery Calcium Scans: History, Assumptions, Current Limitations, and Future Directions." Atherosclerosis 239, No. 1 (Mar. 2015): 109-17.
Glodny, B., et al., "A Method for Calcium Quantification by Means of CT Coronary Angiography Using 64-Multidetector CT: Very High Correlation with Agatston and Volume Scores." European Radiology 19, No. 7 (Jul. 2009): 1661-68.
Hong, C., et al., "Coronary Artery Calcium: Absolute Quantification in Nonenhanced and Contrast-Enhanced Multi-Detector Row CT Studies." Radiology 223, No. 2 (May 2002): 474-80.
Lancerotto, L. et al., Mechanisms of action of external volume expansion devices. Plast Reconstr Surg. Sep. 2013;132(3):569-78.
Chin, M., et al., Analysis of Neuropeptides in Stretched Skin, Plastic and Reconstructive Surgery Jul. 2009.
Carpaneda, C.A., et al., Percentage of graft viability versus injected volume in adipose autotransplants. Aesthetic Plast Surg 18: 17-19, 1994.
Niechajev, I., et al., Long-term results of fat transplantation: clinical and histologic studies. Plast Reconstr Surg 94: 496-506, 1994.
Ersek, R.A., Transplantation of purified autologous fat: a 3-year follow-up is disappointing. Plast Reconstr Surg 87: 219-227; discussion 228, 1991.
Carroll, S.M., et al., Vascular delay and administration of basic fibroblast growth factor augment latissimus dorsi muscle flap perfusion and function. Plast Reconstr Surg. Mar. 2000;105(3):964-71.
Coleman SR Structural fat grafting: more than a permanent filler. Plast Reconstr Surg. Sep. 2006;118(3 Suppl):108S-120S.
Coleman SR, Saboeiro AP. Fat grafting to the breast revisited: safety and efficacy. Plast Reconstr Surg. Mar. 2007;119(3):775-85.
Strong, A.L., et al., The Current State of Fat Grafting: A review of Harvesting, Processing, and Injection Techniques. Plast Reconstr Surg. Jun. 16, 2015.
Rao, A. et al., Defining Fact Necrosis in Plastic Surgery. Plast. Reconstr. Surg. Dec. 2014;134(6):1202-12.
Eto, H., et al., The fate of adipocytes after nonvascularized fat grafting: evidence of early death and replacement of adipocytes. Plast Reconstr Surg. May 2012;129(5):1081-92.
Fiorina, P., et al., The mobilization and effect of endogenous bone marrow progenitor cells in diabetic wound healing. Cell Transplant. 2010;19(11):1369-81.
Kato, H., et al., Normobaric hyperoxygenation enhances initial survival, regeneration, and final retention in fat grafting. Plast Reconstr Surg. Nov. 2014;134(5):951-9.
Paik, K.J., et al., Studies in Fat Grafting: Part V. Cell-Assisted Lipotransfer to Enhance Fat Graft Retention Is Dose Dependent. Plast Reconstr Surg. Jul. 2015;136(1):67-75.
Bellas, E, et al., Injectable silk foams for soft tissue regeneration. Adv Healthc Mater. Feb. 18, 2015;4(3):452-9.
Khouri, R.K., et al., Tissue-engineered breast reconstruction with brava-assisted fat grafting: a 7-year, 488-patient, multicenter experience. Plast Reconstr Surg. Mar. 2015;135(3):643-58.
Khouri, R.K., et al., Brava and autologous fat transfer is a safe and effective breast augmentation alternative: results of a 6-year, 81-patient, prospective multicenter study. Plast Reconstr Surg. May 2012;129(5):1173-87.
Khouri, R.K. et al., Aesthetic applications of Brava-assisted megavolume fat grafting to the breasts: a 9-year, 476-patient, multicenter experience. Plast Reconstr Surg. Apr. 2014;133(4):796-807.
Coleman, S.R., Structural fat grafting. Aesthet Surg J. Sep.-Oct. 1998;18(5):386-388.
Kato, H., et al. Degeneration, regeneration, and cicatrization after fat grafting: dynamic total tissue remodeling during the first 3 months. Plast Reconstr Surg. Mar. 2014;133(3):303e-313e.
Freshwater, M.F., Brava and autologous fat transfer as a safe and effective breast augmentation alternative. Plast Reconstr Surg. Nov. 2012;130(5):753e-754e.
Uda, H., et al., Brava and autologous fat grafting for breast reconstruction after cancer surgery. Plast Reconstr Surg. Feb. 2014;133(2):203-13.
Del Vecchio, D.A., et al., Breast augmentation using preexpansion and autologous fat transplantation: a clinical radiographic study. Plast Reconstr Surg. Jun. 2011;127(6):2441 50.
Garza, R.M., et al., Studies in Fat Grafting: Part IV. Adipose-derived stromal cell gene expression in cell-assisted lipotransfer. Plast Reconstr Surg. Dec. 12, 2014.
Pietramaggiori, G., et al., Tensile forces stimulate vascular remodeling and epidermal cell proliferation in living skin. Ann Surg. Nov. 2007;246(5):896-902.
Lancerotto, L., et al., Mechanoregulation of Angiogenesis in Wound Healing. Adv Wound Care (New Rochelle). Oct. 1, 2014;3(10):626-634.
Erba, P., et al., Angiogenesis in wounds treated by microdeformational wound therapy. Ann Surg. Feb. 2011;253(2):402-9.
O'Toole, G., et al., A review of therapeutic angiogenesis and consideration of its potential applications to plastic and reconstructive surgery. Br J Plast Surg. Jan. 2001;54(1):1-7.
International Search Report and Written Opinion, for PCT/US2016/018164, dated Apr. 21, 2016, 17 pages.
Budoff, M.J., et al., "Coronary Artery and Thoracic Calcium on Non-Contrast Thoracic CT Scans: Comparison of Ungated and Gated Examinations in Patients from the COPD Gene Cohort." Journal of Cardiovascular Computed Tomography 5, No. 2 (2011): 113-18.
Budoff, M.J., et al., "Coronary Calcium Predicts Events Better with Absolute Calcium Scores than Age-Sex-Race/ethnicity Percentiles: MESA (Multi-Ethnic Study of Atherosclerosis)." Journal of the American College of Cardiology 53, No. 4 (Jan. 27, 2009): 345-52.
Kim, S.M., et al., "Coronary Calcium Screening Using Low-Dose Lung Cancer Screening: Effectiveness of MDCT with Retrospective Reconstruction." AJR. American Journal of Roentgenology 190, No. 4 (Apr. 2008): 917-22.
Takx, R. et al., "Automated Coronary Artery Calcification Scoring in Non-Gated Chest CT: Agreement and Reliability." Edited by Arrate Munoz-Barrutia. PLoS One 9, No. 3 (Mar. 13, 2014).
Brunner, G., et al., "Toward Unsupervised Classification of Calcified Arterial Lesions." In Medical Image Computing and Computer-Assisted Intervention—MICCAI 2008, edited by Dimitris Metaxas, Leon Axel, Gabor Fichtinger, and Gábor Székely, 144-52. Lecture Notes in Computer Science 5241. Springer Berlin Heidelberg, 2008.
Isgum, I. et al., "Automated Aortic Calcium Scoring on Low-Dose Chest Computed Tomography." Medical Physics 37, No. 2 (Feb. 2010): 714-23.
Kurkure, U. et al., "A Supervised Classification-Based Method for Coronary Calcium Detection in Non-Contrast CT." The International Journal of Cardiovascular Imaging 26, No. 7 (Oct. 2010): 817-28.
Mittal, S. et al., "Fast Automatic Detection of Calcified Coronary Lesions in 3D Cardiac CT Images." In Machine Learning in Medical Imaging, 1-9. Springer, 2010.
Saur, S. et al., "Automatic Detection of Calcified Coronary Plaques in Computed Tomography Data Sets." In Medical Image Computing and Computer-Assisted Intervention—MICCAI 2008, edited by Dimitris Metaxas, Leon Axel, Gabor Fichtinger, and Gábor Székely, 170-77. Lecture Notes in Computer Science 5241. Springer Berlin Heidelberg, 2008.
Shahzad, R., et al., "Automatic Segmentation, Detection and Quantification of Coronary Artery Stenoses on CTA." The International Journal of Cardiovascular Imaging 29, No. 8 (Aug. 8, 2013): 1847-59.
Shahzad, R., et al., "Automatic Classification of Calcification in the Coronary Vessel Tree." Accessed Dec. 1, 2014.
Shahzad, R., et al., "Vessel Specific Coronary Artery Calcium Scoring: An Automatic System." Academic Radiology 20, No. 1 (Jan. 2013): 1-9.
Budoff, M., et al., "Reproducibility of Coronary Artery Calcified Plaque with Cardiac 64-MDCT: The Multi-Ethnic Study of Atherosclerosis." AJR. American Journal of Roentgenology 192, No. 3 (Mar. 2009): 613-17.
Erbel, R., et al., "Coronary Risk Stratification, Discrimination, and Reclassification Improvement Based on Quantification of Subclini-

(56) References Cited

OTHER PUBLICATIONS cal Coronary Atherosclerosis: The Heinz Nixdorf Recall Study." Journal of the American College of Cardiology 56, No. 17 (Oct. 19, 2010): 1397-1406.
Jacobs, P., et al., "Coronary Artery Calcification Scoring in Low-Dose Ungated CT Screening for Lung Cancer Interscan Agreement." AJR. American Journal of Roentgenology 194, No. 5 (May 2010): 1244-49.
Mylonas, I., et al., "Quantifying Coronary Artery Calcification from a Contrast-Enhanced Cardiac Computed Tomography Angiography Study." European Heart Journal—Cardiovascular Imaging 15, No. 2 (Feb. 1, 2014): 210-15.
Polonsky, T., et al., "Coronary Artery Calcium Scores Using Nongated Computed Tomography What to Do With Incidental Results?" Circulation: Cardiovascular Imaging 6, No. 4 (Jul. 1, 2013): 494-95.
Wu, M.T., et al., "Coronary Arterial Calcification on Low-Dose Ungated MDCT for Lung Cancer Screening: Concordance Study with Dedicated Cardiac CT." AJR. American Journal of Roentgenology 190, No. 4 (Apr. 2008) 923-28.
Xie, X., et al., "Validation and Prognosis of Coronary Artery Calcium Scoring in Nontriggered Thoracic Computed Tomography Systematic Review and Meta-Analysis." Circulation: Cardiovascular Imaging 6, No. 4 (Jul. 1, 2013): 514-21.
Huang, Chenyu, et al. "Effect of negative pressure wound therapy on wound healing." Current problems in surgery 51.7 (2014): 301-331.
Malmsjo, M., et al., The effects of variable, intermittent, and continuous negative pressure wound therapy, using foam or gauze, on wound contraction, granulation tissue formation, and ingrowth into the wound filler. Eplasty. 2012;12:e5.
Thomas, S, An introduction to the use of vacuum assisted closure, http://www.worldwidewounds.com/2001/may/Thomas/Vacuum-Assisted-Closure.html, May 2001.
Saxena, V. et al., Vacuum-Assisted Closure: Microdeformations of Wounds and Cell Proliferation, Plastic and Reconstructive Surgery. 114(5):1086-1096, Oct. 2004.
Budinskaya, O., et al., Vacuum-induced Suction Stimulates Increased Numbers of Blood Vessels in Healthy Dog Gingiva, Wounds 2012;24(4):99-109.
Lanceretto, L., et al., External Volume Expansion (EVE) in Recipient Site Preparation to Fat Grafting: Effects and Mechanisms, Presentation, 2015.
Chin, M., et al., "In Vivo Acceleration of Skin Growth Using A Servo-controlled Stretching Device," Tissue Engineering Part C, vol. 15, No. 00, Jul. 2009.
Zheng, D.N., et al., Autologous fat grafting to the breast for cosmetic enhancement: experience in 66 patients with long-term follow up. J Plast Reconstr Aesthet Surg 61: 792-798, 2008.
Khouri, R. K., et al. Nonsurgical breast enlargement using an external soft-tissue expansion system. Plast Reconstr Surg 105: 2500-2512; discussion 2513-2504, 2000.

* cited by examiner

SYSTEMS AND METHODS FOR PROMOTION OF ANGIOGENESIS AND ADIPOGENESIS IN TISSUES THROUGH APPLICATION OF MECHANICAL FORCES

CROSS-REFERENCE TO RELATED APPLICATIONS

This application represents the national stage entry of PCT International Application PCT/US2016/018164 filed Feb. 17, 2016, which claims benefit of U.S. Provisional Application 62/117,011 filed Feb. 17, 2015, all of which is incorporated herein in its entirety by reference.

STATEMENT REGARDING FEDERALLY SPONSORED RESEARCH

N/A

BACKGROUND

The present disclosure relates to systems and methods for promoting angiogenesis and adipogenesis in tissue. More particularly, the disclosure relates to the creation of specific intermittent and cyclical patterns of application of mechanical forces through suction (e.g., vacuum) to promote angiogenesis and adipogenesis in vivo and in artificial tissue or tissue explants in vitro.

Soft tissue grafting and surgical soft tissue flaps have the potential advantage of being a physiologic, natural-looking treatment for reconstructing or repairing tissue deficits, making these techniques workhorses in reconstructive surgery for trauma, malformations, or tumor resections, for example. However, current procedures are in some cases still limited by complications, such infections or partial or total loss (i.e., necrosis) of the grafted or transplanted soft tissue or tissue flap due to insufficient vascular supply in the donor site. In addition, many tissue grafts survive at an unpredictable rate, often with inverse correlation to the size and volume of grafted or transplanted tissue.

Fat grafting, a soft tissue grafting technique, is emerging as a valuable alternative to current breast reconstruction and augmentation procedures which rely on local or free flaps or silicone implants that can cause donor site morbidity, complications, or foreign body reactions. However, in its current state, fat grafting remains limited by partial efficacy. Often, fat grafts survive at an unpredictable rate (e.g., 30 to 80% take), with inverse correlation to injected volume. Therefore, multiple sessions of treatment are required to achieve satisfactory volumes. Recently, research efforts have been undertaken to manipulate the fat tissue to improve engraftment. The experience with skin grafts suggests that improvement of the quality of the recipient site may positively affect the efficacy of fat grafting.

In addition to unsatisfactory volumes, other common limitations of reconstructive surgeries can include excessive tissue stiffness due to scarring and absence of adequate sliding, or absence of protective layers due to insufficient or lacking subcutaneous fat component. Therefore, it is not uncommon to meet complications or unsatisfactory results that require multiple sessions of treatment to achieve satisfactory outcomes. Transplanted soft tissues rely initially on diffusion and subsequently on new vessels sprouting from the recipient site. A poor vessel density-to-grafted volume ratio and higher compartment pressure in the recipient site following grafting are likely factors that negatively affect perfusion of soft tissue grafts.

Alternatively, grafts may be manipulated in their taking phase or later by stimulating adipogenesis. Recent research on grafts, however, has been focused on modifying harvesting techniques, as well as enriching the grafts by growth factors or cell therapies. Thus, the amount of research on the recipient area has remained low and limited effective techniques are available to modulate graft development.

To overcome some of the above described limitations of reconstructive surgeries, the application of mechanical forces on tissue have been utilized. Mechanical forces are known to have a fundamental role in biologic systems. In addition, the application of mechanical forces has been an adjunct to surgery. Tissue expansion allows gradual lengthening of soft tissues, including nerves and blood vessels. Tension wound-approximation devices close wounds over time. Application of sub-atmospheric pressure to wounds has been shown to increase the vascular supply within the wound and to accelerate healing. All of the above forces are directed at the wound in a single dimension and applied evenly over large areas. In the past, plastic surgeons have used these phenomena to their advantage to expand skin in order to accommodate prosthetic implants.

Other surgical techniques have used tissue expansion to achieve other types of soft tissue growth. For instance, balloons have been successfully expanded underneath nerves, veins, tendons, and the like to thereby elongate these tissues to repair damage and alleviate various abnormalities. However, each of the above-mentioned apparatuses and methods requires an invasive surgical technique to accomplish the soft tissue expansion. Invasive techniques increase the likelihood of the complications associated with the procedure including those mentioned above with respect to implant surgery. In addition, the expense of surgery precludes many persons from having their abnormalities corrected or physical attributes enhanced.

Alternatively, external volume expansion (EVE) devices may be used for nonsurgical breast augmentation. Despite this non-invasive approach, the high costs of large trials, complexity of clinical data analysis, and poor patient compliance to EVE contribute to limited data, leading to some debate over the adoption of EVE-pretreatment as routine practice in fat grafting protocols. Currently, patients undergoing EVE and autologous fat transfer are mostly instructed to wear the device continuously, for extended periods of time over several weeks. Thus, patient compliance with the protocol varies and undesirable side effects such as skin rashes, blistering, lactation, sleep interruption, and a limited social life are reported.

In addition, some devices apply mechanical forces to wounded tissue. Other conventional devices are often used to treat closed wounds and incisions, or for draining and/or irrigating tissue separations, such as surgical incisions. Thus, these devices fail to provide applications for un-injured soft tissues. Further, these devices often fail to identify the patterns of stimulation to be used, the potential danger to the intact skin tissues, or indications as to how the device is to be used.

In one device for wound healing or enlargement of soft tissue, a dome is configured to fit over the area of desired augmentation and of a suction force of sufficient magnitude is applied to the dome to cause healing/enlargement of the soft tissue. The device further includes a servomechanism for regulating the pressure within the dome to any one of several protocols using pressures, which might temporarily exceed non-damaging levels. The device is configured for stimulation of tissue growth and soft tissue enlargement, or enlarging the surrounding soft tissue to close the wound, through vacuum alone. To achieve this end, the device is designed for continuous application of forces (i.e., suction) and use, such that stimulation is suggested to last at least 10 days to provide effective results.

Not surprisingly, end users have found extended periods, even those that last but a few days, let alone 10 days, to be a substantial impediment to quality of life. Thus, the daily duration of continuous application and total duration of treatment in days required by such devices remarkably affects the compliance of patients to treatment, the number of drops out from treatment and, as a consequence, final clinical outcomes.

Thus, there is a need for systems and methods that non-invasively and precisely enhance vascularity in a recipient site in preparation to a tissue graft or flap. There is also a need for systems and methods that efficiently improve surgical outcomes while controlling complications or negative side effects for the patient.

SUMMARY

The present disclosure provides systems and methods that overcome the aforementioned drawbacks by providing a system and method for exerting mechanical forces on individual cells to switch on specific genes that cause cell proliferation and regulate various cell functions necessary for tissue development of un-wounded tissues. More particularly, systems and methods are provided for transmitting mechanical forces locally to induce pro-angiogenic stimulation into soft tissues for promoting angiogenesis in vivo and in artificial tissue or tissue explants in vitro. These mechanical forces induce a moderate stretching of individual cells, as well as a temporary ischemia and a mild inflammation, stimulating endothelial cell proliferation and creating a pro-adipogenic environment. Specific intermittent and cyclical patterns (e.g., frequency, duration, intensity, etc.) are regulated to control and predict angiogenic and adipogenic response in tissues. Mechanical forces can be applied directly to tissue, through a concave-shaped suction device, bio-molecules or other interfacing biomaterials or synthetic materials. Finite Element Modeling (FEM) may be used to customize patterns of mechanical stimulation based on the specific characteristics of the treated tissue.

In accordance with one aspect of the disclosure, a tissue enlargement apparatus is provided that includes an interface configured for affixation to the soft tissue. A force generating device is coupled to the interface by a connecting tube for applying mechanical forces to the soft tissue. A processor is coupled to the force generating device and is configured to apply intermittent cyclical patterns of the mechanical forces to the soft tissue to promote angiogenesis and adipogenesis in soft tissue. The intermittent cyclical patterns are based on at least one of duration, frequency, and intensity of the mechanical forces.

In accordance with another aspect of the disclosure, a tissue enlargement apparatus is provided for promoting angiogenesis and adipogenesis in soft tissue. The tissue enlargement apparatus includes an interface configured for affixation to the soft tissue, a force generating device coupled to the interface by a connecting tube for applying mechanical forces to the soft tissue, and a processor coupled to the force generating device and configured to apply intermittent cyclical patterns of the mechanical forces to the soft tissue to promote angiogenesis and adipogenesis in soft tissue that includes predetermined off-suction or reduced-suction periods and on-suction periods designed to extend over predetermined duration or number of sessions. The intermittent cyclical patterns are based on at least one of duration, frequency, and intensity of the mechanical forces and include on-suction periods of between about 10 minutes and about 4 hours and off-suction or reduced-suction periods of between about 10 minutes and about 24 hours.

In accordance with yet another aspect of the disclosure, a method is provided for promoting angiogenesis and adipogenesis in soft tissue. The method includes affixing an interface to the soft tissue, applying mechanical forces to the soft tissue through the interface using a force generating device coupled thereto, and applying intermittent cyclical patterns of the mechanical forces to the soft tissue. The method also includes monitoring a micro-environment of the soft tissue to determine whether the intermittent cyclical patterns of the mechanical forces are selected for promoting angiogenesis and adipogenesis in the soft tissue, analyzing how the mechanical forces are distributed on the soft tissue when the intermittent cyclical patterns are below a predetermined efficiency, and adjusting at least one of the mechanical forces and the intermittent cyclical patterns to raise the mechanical forces distributed on the soft tissue above the predetermined threshold.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DETAILED DESCRIPTION

As discussed, some have attempted to design devices that achieve enlargement of soft tissue. Such system typically include a dome that is configured to fit over the area of desired augmentation and of a suction force of sufficient magnitude is applied to the dome to cause healing/enlargement of the soft tissue. The device is configured for stimulation of tissue growth and soft tissue enlargement, or enlarging the surrounding soft tissue to close the wound, through vacuum alone. Again, to achieve this end, the device is designed for continuous application of forces (i.e., suction) and use, such that stimulation is suggested to last at least 10 days to provide effective results and not surprisingly, end users have found such extended periods to be a substantial impediment to quality of life. Thus, the daily duration of continuous application and total duration of treatment in days required by such devices remarkably affects the compliance of patients to treatment, the number of drops out from treatment and, as a consequence, final clinical outcomes.

The above described methods and devices that rely on continuous suction do not recognize the importance of angiogenesis in the preparation of a recipient site for a tissue graft or in preconditioning of a surgical flap or in tissue engineering. Also, these systems and methods involve the adoption of pattern-specific mechanical stimulations to induce adipogenesis as a means to improve tissue engineering approaches. Most of these devices and methods have failed to achieve significant long term soft tissue enlargement by themselves, and for optimal results these devices may need to be combine with tissue grafting, which mostly relies on optimization of recipient site vascularity.

Instead, as will be described, the present disclosure provides systems and methods that non-invasively promote angiogenesis and adipogenesis of tissue by precisely enhancing vascularity in a recipient site in preparation to a tissue graft or flap through the use of mechanical forces in an un-injured tissue, healthy tissue, tissue grafts/flaps, scaffolds, and the like. The present systems and methods can determine the most efficient stimulation intermittent and cyclical parameters, so that surgical outcomes can be designed and/or optimized and complications or negative side effects for the patient can be inhibited.

Figure 1A:
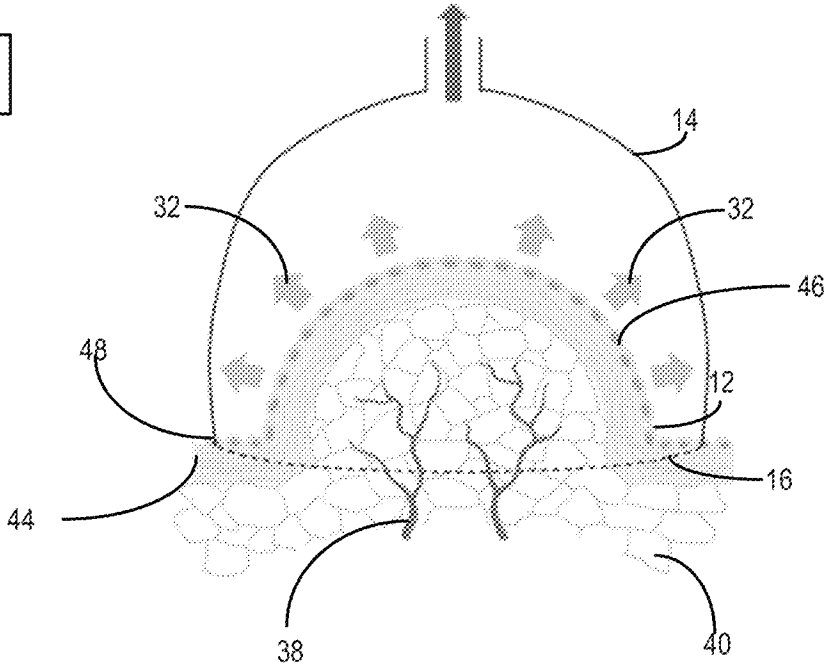
FIG. 1A is an enlarged view of the tissue of FIG. 1 having the mechanical forces applied thereon to promote angiogenesis and adipogenesis.
Figure 1:
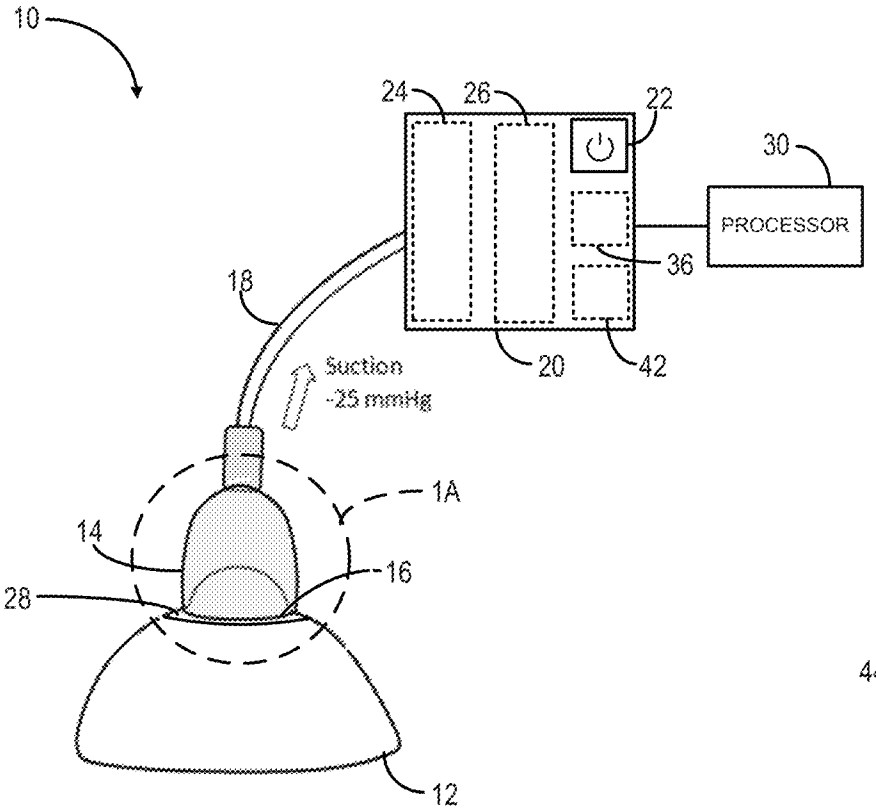
FIG. 1 is a side view of a tissue enlargement apparatus including a force generating device coupled to a dome-shaped interface for providing mechanical forces to tissue according to one aspect of the present disclosure.

Referring particularly now to FIG. 1, a tissue enlargement apparatus 10 is shown that is configured to promote angiogenesis and adipogenesis in tissue 12. Preferably, the tissue enlargement apparatus 10 is used in unbreached, healthy or otherwise normal tissue sources, as opposed to wounded tissues or wound injury scenarios. In general, the tissue enlargement apparatus 10 includes an interface 14 having a rim 16 and a tube 18 that connects the interface 14 to a force generating device 20. The force generating device 20 may be a vacuum pump, for example, driven by a power source 22. The force generating device 20 can be a separate device or a self-contained device with the power source 22, a pressure sensor 24, and a mechanism 26 for regulating and controlling the force generating device 20. The mechanism 26 for regulating and controlling the forces may include, for example, mechanical control systems, micro-fluidic control systems, and/or servomechanism and may be coupled with electronic feedback from a sensor that assesses for skin damage or decreases in skin blood flow. The interface 14 may be applied directly to, or over, the tissue 12 surface using a connector 28 that extends along the rim 16 of the interface 14. The connector 28 may include, for example, flexible laces or standard adhesive polyurethane sealing dressings. In one non-limiting example, a processor 30 may be in communication with the force generating device 20 and configured to receive data related thereto in order to control the intermittent and cyclical application of mechanical forces 32 to promote angiogenesis and adipogenesis in the tissue 12, as will be described in further detail below.

In some configurations, the interface 14 may be a concave or dome-shaped suction interface, as shown in FIG. 1, that transmits the mechanical forces 32 (i.e., suction) to the tissue 12 through the force generating device 20 to create a negative pressure inside the dome-shaped interface. The size, shape, and material of the interface 14 can be customized based on the morphologic characteristics of the tissue 12 and based on preliminary FEM to predict mechanical response of the considered tissue. The interface 14 may be constructed from metallic components or non-degradable polymers, such as polyurethane and polydimethylsiloxane. In other configurations, the interface 14 may be constructed from biodegradable polymers including, but not limited to, collagen, fibrin, polylactic acid (PLA), polyglycolic acid (PGA), and polymethyl acrylate (PMA). The materials of the interface 14 may be applied to superficial or deep tissue grafts or implanted/injected biomaterials and exert local mechanical distending forces 32 at the centimeter to millimeter scale. These forces 32 distend large regions of the material in order to accelerate angiogenesis and enhance tissue vascularity or to stimulate adipogenesis throughout the depth of the tissue without further invasive procedures (i.e., without further surgery or injections).

In yet another example, the composition and structure of the interface 14 material may vary and include in different variants bio-material, interactive "smart biomaterials", drug-delivery polymers, bio-compatible synthetic materials, and the like. In an alternative configuration, smart polymers could be adopted as a sponge-like interface, as will be described in further detail below, to continuously monitor the degree of angiogenesis and provide feedback to the force generating device 20, resulting in a continually adjusted and/or optimized level of applied load and strain. To further promote angiogenesis or adipogenesis in the tissue 12, drugs (e.g., mitogens) can be locally delivered by modified drug-coated sponge-like biomaterials. Other drugs of use include soluble growth factors, angiogenic or adipogenic factors, vitamins, peptides and genetic material. Incorporation of these drugs into the polymer construct of the tissue enlargement apparatus 10 can be designed for controlled release over time. Drug delivery can similarly be injected into the moving fluid at preprogrammed times and continuously monitored by the processor 30, 130.

The interface 14 may also be coated with peptide fragments, synthetic molecules, and growth factors, for example to enhance cell proliferation and differentiation. Combining the mechanical forces 32 with exogenous growth factors and cytokines, optimization of mechanical forces application and drug delivery with mathematical modeling and feedback control, and other factors to control edema, minimize infection and inflammation. In addition, angiogenesis and adipogenesis may be facilitated by employing the design of "smart-material" based devices that allow desired or optimal transmission of mechanical forces, and fabrication of materials, which locally concentrate stress when forces are applied over large areas of the material.

Figure 2:
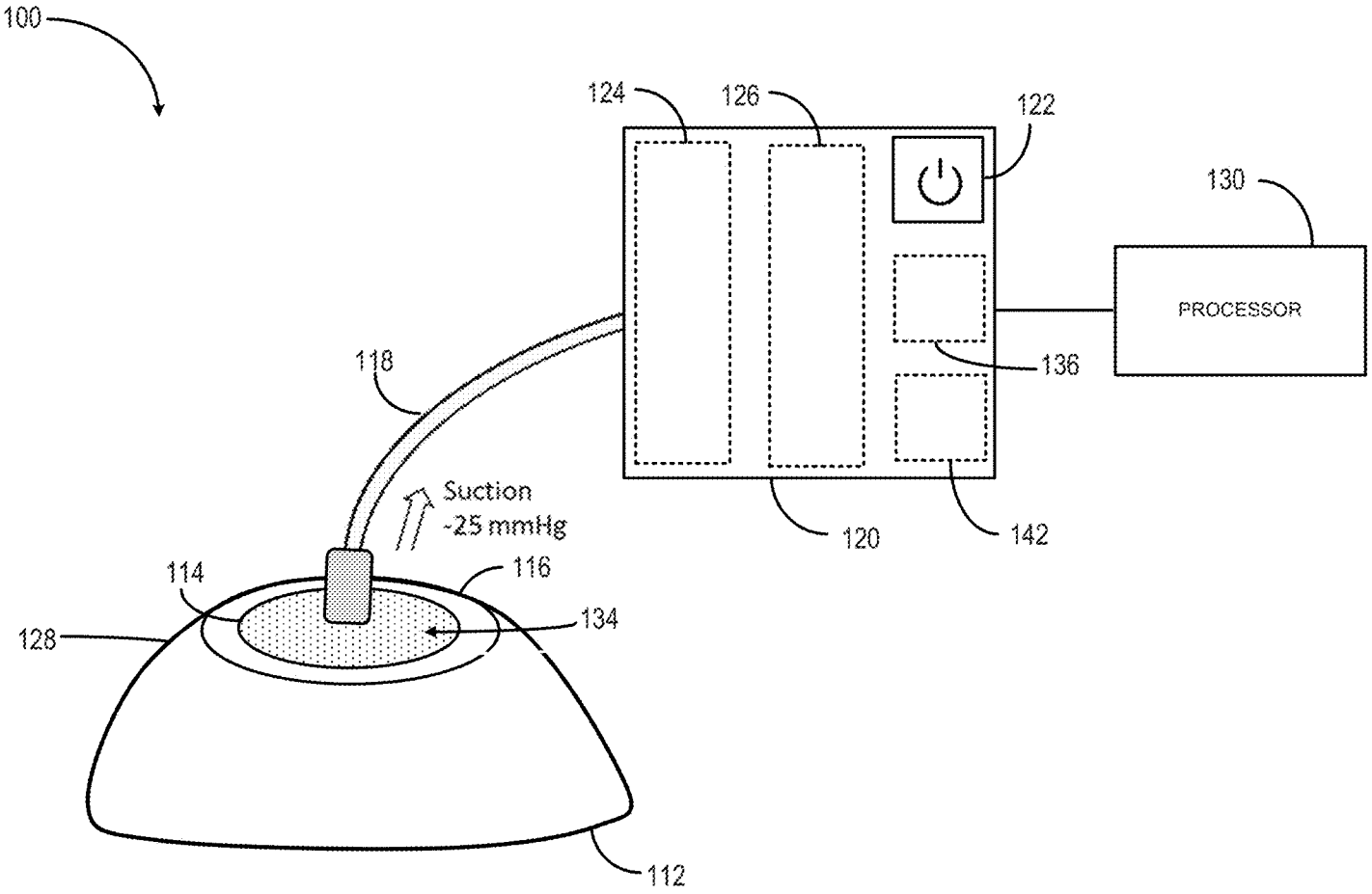
FIG. 2 is a side view of another tissue enlargement apparatus including a force generating device coupled to a sponge-like interface for providing mechanical forces to tissue according to one aspect of the present disclosure.

Turning now to FIG. 2, in an alternative configuration, a tissue enlargement apparatus 100 is shown. The tissue enlargement apparatus 100 is similar to the tissue enlargement apparatus 10 of FIG. 1 except for the interface 114, thus similar reference numerals are for the various components. The interface 114 may be a sponge-like interface having a plurality of pores 134 that is connected to the force generating device 20 via the connecting tube 118. The sponge-like interface may be directly placed on the surface of the tissue 112. In one configuration, the interface 114 may be constructed from a sponge made of polyurethane. The mechanical forces that are applied globally to the sponge surface are concentrated locally due to the geometric constraints of the shape, size, and distribution of the plurality of pores 134. The shape and size of the plurality of pores 134 can be selected and/or optimized using the processor 130 which may be configured to apply computer design and analysis to provide desired and/or optimal concentrations of stresses locally. The interface 114 may contain the plurality of pores 134 with defined shape, size, and location on the millimeter to submicron scales. In addition, the size and the shape of the sponge-like interface 114 can be customized based on the morphologic characteristics of the tissue 112 based on preliminary FEM to predict mechanical response of the considered tissue.

In the above described configurations the tissue enlargement apparatus 10, 100 may generally be portable and may be positioned under a patient's clothes, directly on the tissue. In some configurations, the tissue enlargement apparatus 10, 100 can be automated, self-contained, and built into a closed battery-powered unit that the patient can wear on top of the tissue, thus allowing ambulation. In one non-limiting example, multiple tissue enlargement apparatuses 10 can be used simultaneously on different areas of soft tissues 12 in the same individual. Each interface 14 could use a different force generating devices 20 or, alternatively, each interface 14 may be connected to the others by a conduit tube (not shown) and use a single force generating device 20.

In one non-limiting example, one or more sensors 36, such as a biosensor, may be employed in the tissue enlargement apparatus 10, 100 as part of a feedback control system for selecting and/or optimizing the rate of angiogenesis and adipogenesis. Depending on the particular soft tissue 12 type, strains and rates of strains can be time-dependent, or even dependent on the surgical procedure scheduled after pre-conditioning or before conditioning. In one non-limiting example, the strain may be between about 5% and about 50%, where strain is defined by $(l-l_0)/l$ (i.e., $l$=current length and $l_0$=original length). Therefore, to use the tissue enlargement apparatus 10 to deliver desirable levels of angiogenic or adipogenic stimulation, self-adjusting polymers, for example, may be used for adapting force generation automatically to the state of angiogenesis or adipogenesis.

In addition to such implicit feedback regulation, biological or physical markers of angiogenesis or adipogenesis can be used to detect such changes in the tissue 12. Examples of such markers include either changes that are correlated with angiogenesis, for instance, the tissue 12 may become warmer as it improves perfusion, its color may change, the level of swelling/edema may rise, or any of these and other events may occur in combination to give an indication of angiogenic development process. Similar markers can be identified for adipogenesis, including soluble biological markers. Alternately a lack of any of these markers may signal that the tissue enlargement apparatus 10 is producing either a too high or a too low an output.

Sensor mechanisms that take advantage of the above markers might include an optical device, for example that can detect color changes or hemoglobin levels due to the growth of new blood vessels 38 within adipocytes 40 of the tissue 12 (see FIG. 1A). The sensors 36 would input data into the processor 30, and, as a result, a change in the stimulation pattern, a change in stimulation duration, a change in pressure, etc. may be outputted. In one example, the sensors 36 can also direct a change in the level of drug delivery given to the tissue 12. In yet another example, the tissue enlargement apparatus 10 may include another sensor 42, such as a piezoelectric sensor to measure dynamic pressures on the tissue 12 generated from the force generating device 20.

In some configurations, finite element analysis (FEA) can be used to evaluate and enhance the dome-shaped interface 14 or the sponge-based interface 114 to the specific tissue source. FEA may be used to solve boundary value problems where closed form analytic solutions may be intractable. A mathematical model is used to model the geometry at discrete points, and the boundary of the modeled points is loaded with the forces and constraints that define the boundary conditions. Equations may be set up by the processor 30 based on the geometry that relates points inside the structure to points involving the boundary conditions. A finite element model (FEM) can predict preferable or optimal pore design of non-degradable materials, such as polyurethane. In addition, the FEM allows calculation of desirable and/or optimal force application to a variety of biological tissues that can be characterized by their stiffness or Young's modulus of elasticity. Some tissues, such as mucosa and fat 40 (see FIG. 1A), are very pliable others such as dermis 44 and fascia are stiffer, and tissues such as cartilage and bone are quite stiff. Thus, the FEM allows the design of pore structure of the interface 14, 114 and selection of applied patterns of stimulation based on the stiffness of the tissue 12.

Analysis of how the forces 32 are distributed within tissues using FEA or advanced sensing technologies, as previously described, provides new data for precision engineering of devices that can be used to select and/or optimize delivery of mechanical forces locally and thus, to exploit the mitogenic pathway for improved angiogenesis and adipogenesis. The tissue enlargement apparatus 10 may be capable of selecting stresses locally to induce precise cellular strains while applying forces over large tissue areas and may be adapted to apply forces on a continuous or cyclical basis with different patterns, as will be described in further detail below. In particular, the adoption of intermittent and cyclical patterns of stimulation from the force generating device 20 may affect, in one example, both the duration of each continuous stimulation to less than 3 hours maximum, the total daily duration of stimulations to less than 9 hours per day, and the weekly distribution of stimulations to once every other day or less.

The force generating device 20, in combination with the processor 30, may be configured to control intermittent and cyclical patterns of mechanical stimulation (i.e., mechanical forces 32) delivered to the tissue 12 that can locally enhance both angiogenesis and adipogenesis. As for negative pressure intensity, when adopting the dome shaped interface 14 (see FIG. 1), the force generating device 20 may apply a vacuum between about 10 to 50 mmHg or, in some cases, about 25 mmHg and about 35 mmHg, when the mechanical forces 32 are maintained for more than about 1 hour consecutively. When mechanical forces 32 are maintained for less than 1 hour, the force generating device 20 may apply a vacuum between about 75 and 125 mmHg or, in some cases, 35 mmHg and about 60 mmHg. Similarly, when adopting the sponge-like interface 114 (see FIG. 2), the force generating device 20 may apply a vacuum less than about 100 mmHg.

Figure 3:
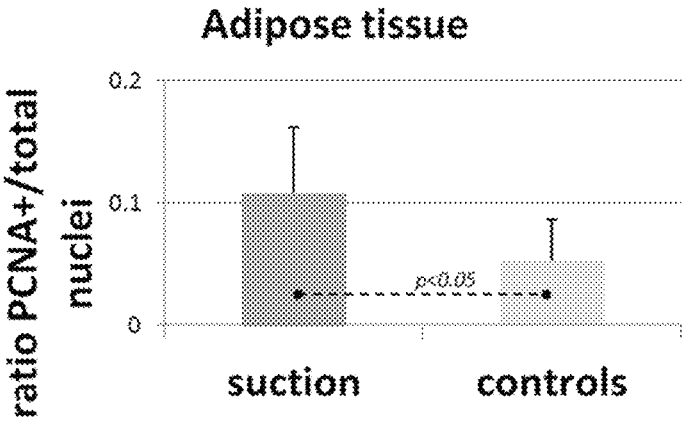
FIG. 3 is a graphical representation comparing a ratio of proliferating cell nuclear antigen (PCNA) and total nuclei representative of cell proliferation for adipose tissue samples.
Figure 4:
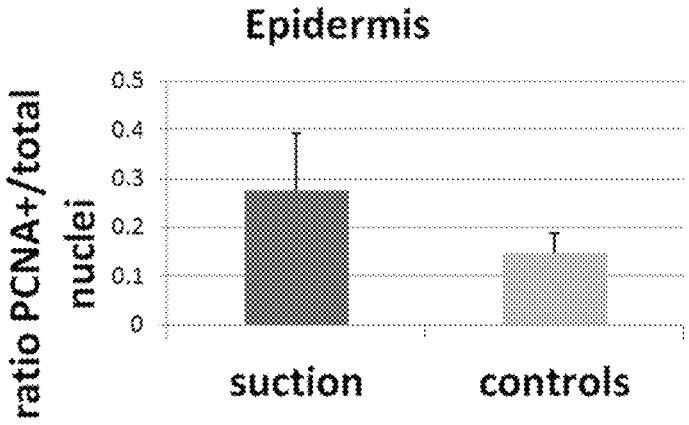
FIG. 4 is a graphical representation comparing the ratio of PCNA and total nuclei representative of cell proliferation for epidermis tissue samples.

The pressure pattern generated by the force generating device 20 may be cycled at a predetermined frequency corresponding to the rate of strain to achieve endothelial cell proliferation or stem cell differentiation and adipogenic commitment. For example, as shown in FIG. 3, adipose tissue having suction applied thereto by the force generating device 20, for example, is shown alongside adipose tissue having no mechanical forces applied thereto. As shown, a significant increase in the adipocytes is shown in the adipose tissue having mechanical forces applied thereto. FIG. 3 shows a graphical representation of the cell proliferation rate in the subcutaneous layer of suction-treated areas increased two-fold. The cell proliferation is represented in FIG. 3 by the ratio of proliferating cell nuclear antigen (PCNA) and total nuclei of the adipose tissue samples. Similarly, as shown in FIG. 4, epidermis tissue having suction applied thereto by the force generating device 20, for example, is shown alongside epidermis tissue having no mechanical forces applied thereto. As shown in FIG. 4, a graphical representation of the cell proliferation rate in the subcutaneous layer of suction-treated areas increased two-fold. The cell proliferation is represented in FIG. 4 by the ratio of PCNA and total nuclei of the epidermis tissue samples.

In one configuration, a daily cyclical stimulation consisting of six daily stimulation sessions of 30 minutes separated by 1 hour of non-stimulation periods between each session is employed by the tissue enlargement apparatus 10. Other configurations include daily cyclical stimulations consisting of 3 or 5 daily stimulation sessions of 1 hour and 30 minutes separated by respectively 4 or 1 hour of non-stimulation periods between each session. Other configurations may include similar cyclical stimulation patterns carried out every other day or every other second day.

In yet another configuration, the patterns of stimulation may be intermittently applied by the force generating device 20 with a ratio between off and on varying between 1 hour/30 minutes and 4 hours/60 minutes. The patterns of stimulation can be controlled manually or automatically by the force generating device 20, and there is no need to remove the interfaces 14, 114 during non-stimulation periods. Advantageously, the tissue enlargement apparatus 10 may be worn during sleep. Thus, patient compliance to treatment may be enhanced, thereby reducing drops out and, consequently, improving overall clinical outcome.

The mechanical forces 32 generated by the force generating device 20 may more efficiently deform cells, such as cells 46 shown in FIG. 1A, and alter the behavior (e.g., growth) of endothelial cells within the blood vessels 38, thereby establishing prerequisite basis for enhanced graft/flap survival and tissue regeneration. The specific patterns of mechanical stimulation may enhance the adipogenic potential by a balance of pro-adipogenic and anti-adipogenic conditions set by the processor 30. In addition, a reduction of total duration of treatment may be reduced to a maximum of 14 days or less, for example. This methodology may be especially useful for promoting angiogenesis in a recipient site in preparation to a graft, however, it also may be useful for stimulating growth or pre-conditioning of tissues in vitro, for example, to increase the vascularity of artificial cellularized tissues created using tissue engineering approaches.

Figure 5:
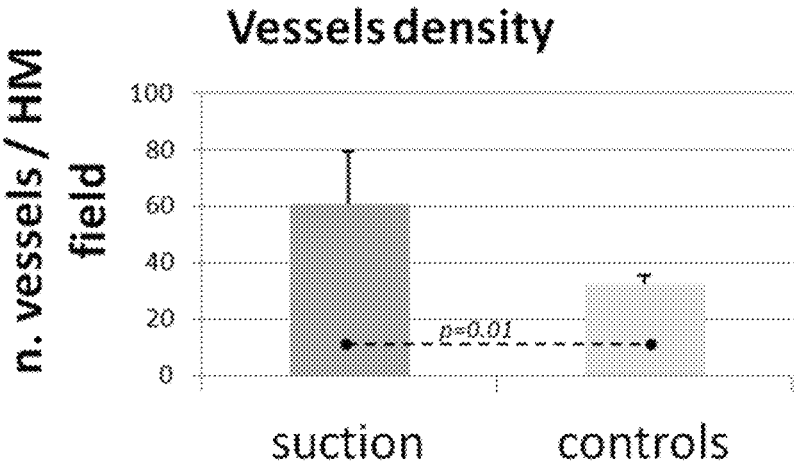
FIG. 5 is a graphical representation comparing the augmentation of vessel density.

For example, as shown in FIG. 5 adipose tissue and blood vessels having suction applied thereto by the force generating device 20, for example, is shown alongside adipose tissue and blood vessels having no mechanical forces applied thereto. As shown, a significant increase in the remodeling of the vessels network occurred, with reorientation and increase of vessels diameters shown by corrosion casting. FIG. 5 shows a graphical representation of the vessel density in the tissue and 1.9-fold augmentation of vessel density.

At a cellular level, the tissue enlargement apparatus 10 may be configured to induce local cell strain using the force generating device 20 to apply suction to uninjured soft tissues. Extra-cellular matrix (ECM) receptors on the cell surface, such as integrins, sense and transduce the mechanical forces to the cytoskeleton. Therefore, the therapeutically applied forces should be directed to the ECM and their interconnected receptors and cytoskeletal linkages. In other words, the mechanical stresses are applied locally to endothelial cells, preadipocytes, and stem cells within the tissues by applying different patterns of suction that induce local stretching of soft tissue surface, topographic changes in the ECM that secondarily stretch cells. These micro-mechanical strains stimulate angiogenesis by promoting endothelial cell proliferation and migration, elaborating of natural soluble growth factors, and stimulating ischemia-mediated and inflammation-mediated angiogenesis. The micro-mechanical strains similarly stimulate adipogenesis by promoting stem cells and preadipocytes proliferation, and stimulating adipogenic commitment and differentiation by elaborating of natural soluble growth factors, and inflammation and edema mediated activation of adipogenic pathways.

In regard to angiogenesis, the mechanical forces play an important role in controlling endothelial cell proliferation. The presence of soluble growth factors alone does not optimize endothelial cell proliferation. For desired and/or optimal cell proliferation, endothelial cells need to be stretched. Moreover, several forms of mechanical forces (i.e., stretch, turbulent flow shear stress, distortion, pressure, etc.) stimulate cell growth, migration, and other biochemical changes necessary for tissue growth and repair. Thus, forces applied to individual cells are important in governing their response to soluble cytokines and ECM molecules.

In summary, the tissue enlargement apparatus 10 may solve the challenge of minimizing invasive procedures while maximizing mechanical stresses-induced angiogenesis or adipogenesis into tissues and hence enhance recipient site preparation for tissue grafting or flap preconditioning or post-conditioning. The tissue enlargement apparatus also improves and/or optimizes angiogenesis or adipogenesis by regulating mechanical stresses exerted at the tissue without having to increase macroscopic forces (e.g., overall stretch) or duration of treatment applied to the whole tissue that may lead to complications, such as pain, skin irritation, and the like.

Figure 6:
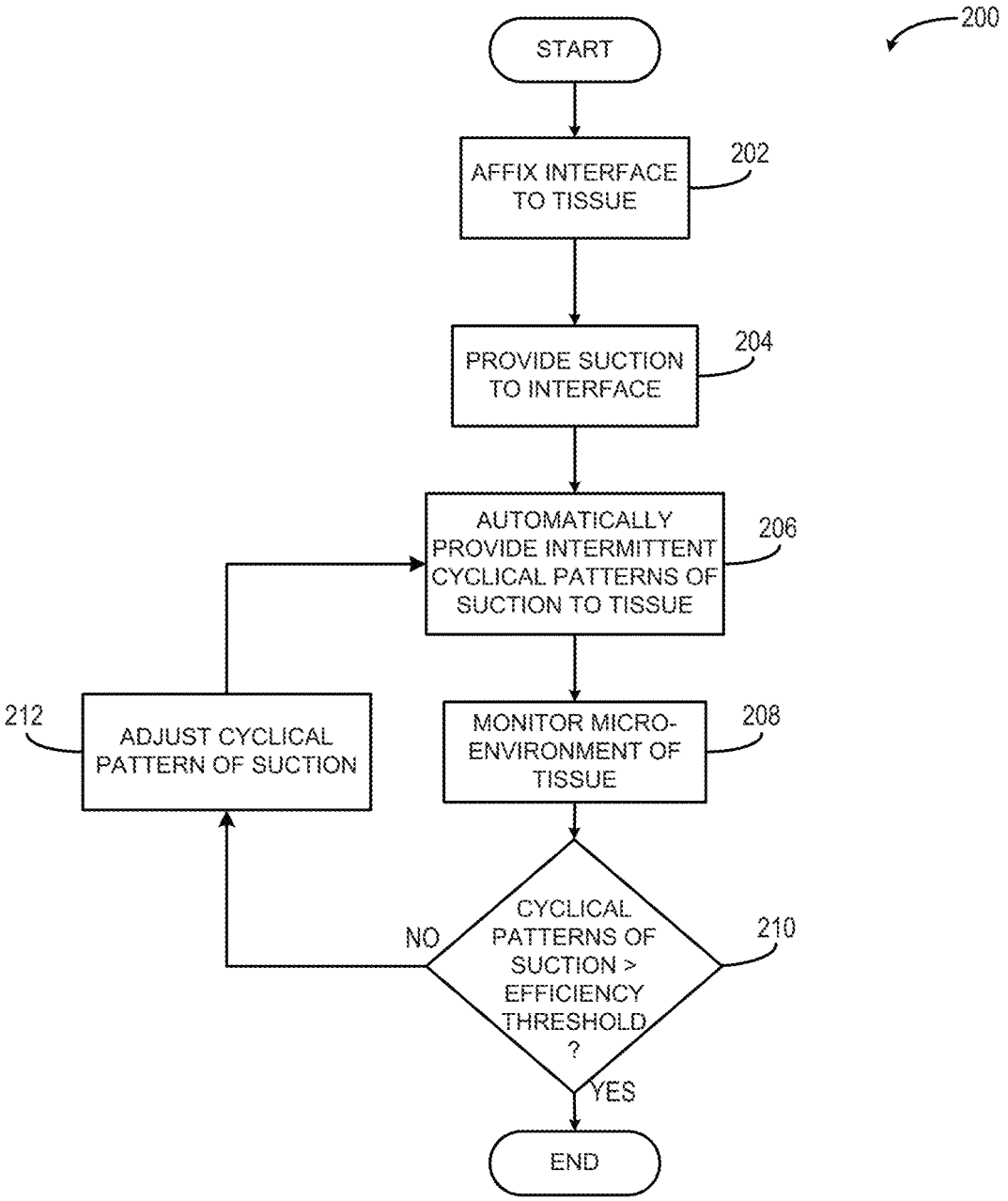
FIG. 6 is a flow chart setting forth the steps of processes for providing mechanical forces to the tissue to promote angiogenesis and adipogenesis in accordance with the present disclosure.

Referring now to FIG. 6, a flow chart setting forth exemplary steps 200 for providing mechanical forces to the tissue is provided. To start the process, the interface, such as the dome-shaped interface 14 shown in FIG. 1 or the sponge-like interface 114 shown in FIG. 2, may be affixed to the tissue of a patient at process block 202. As previously described, the interface 14, 114 may be secured to the tissue 12 using flexible laces or adhesive dressings, for example, in order to seal and hold the interface onto the tissue. Once the interface is attached to the tissue, suction may be provided to the tissue at process block 204. The suction creates mechanical forces 32 on the tissue by providing suction through the connector tube 18 from the force generating device 20. In some configurations, the suction may be provided through a range of about 10 mmHg to about 125 mmHg.

Next, at process block 206, the processor 30 in communication with the force generating device 20 may automatically provide intermittent cyclical patterns of suction to the tissue to promote angiogenesis and adipogenesis. The intermittent cyclical patterns of suction may be based on input data received by the processor related to one or more of duration, frequency, and intensity. For example, the patterns of suction may be based on a ratio between off suction and on suction varying between 1 hour/30 minutes and 4 hours/90 minutes. In addition, the patterns of suction may be based on a number of daily stimulations between 3 and 6, a total number of hours of stimulation daily being less than 6, an overall duration of treatment between 5 and 18 days, a desired and/or optimal pattern consisting of 6 daily stimulation (30 minutes each, followed by 1 hour breaks each) for 5 days of treatment to induce angiogenesis, and stimulations patterns carried out with daily to every second day frequency to induce adipogenesis.

At process block 208, the micro-environment of the tissue can be monitored using the sensor 42 (i.e., piezoelectric gauge). The piezoelectric gauge may be used to measure a temperature of the tissue, tissue perfusion, partial pressure of oxygen ($pO_2$) of the tissue, and partial pressure of carbon dioxide ($pCO_2$) of the tissue. Additionally, or alternatively, the pressure sensor 24 and biosensors 36 previously described may also be used to monitor the micro-environment of the tissue. At decision block 210, the processor can analyze whether the intermittent cyclical patterns of suction being provided to the tissue are sufficiently efficient when compared to a predetermined criteria and/or optimized.

In one example, the efficiency threshold may be a change of at least 5%, for example, in oxyhemoglobin and deoxyhemoglobin as detected by the sensor 42 as a result of the application of suction. In this particular example, the sensor 42 may be a hyperspectral imaging sensor to show decreases in oxyhemoglobin and increases in deoxyhemoglobin when suction is applied to the tissue 12. Some degree of hypoxia may be induced to induce the formation of new blood vessels, however, having hypoxia present for too long (e.g., over 2-3 hours) may result in permanent tissue damage.

In another example, the efficiency threshold may be a predetermined volume of fluid, for example, in the dermal-epidermal junction as detected by the sensor 42. A volume of fluid above the predetermined threshold measured at the dermal-epidermal junction may indicate blistering of the tissue 12. Thus, the suction or cycle time may be reduced based on the measured volume of fluid. Additionally, or alternatively, the sensor 42 may measure a volume within the interface 14, such that the efficiency threshold is based on expansion of the tissue 12 above 10% to 50% of the volume within the interface 14, for example.

If the intermittent cyclical patterns of suction being provided to the tissue are above the predetermined efficiency at decision block 210, the process can end. If, however, the intermittent cyclical patterns of suction are not desirable at decision block 210, the processor may be configured to adjust the pattern at process block 212. For example, the adjustment parameters may be derived from FEA and FEM that is based on the specific mechanical properties of the tissue, as measured by the various sensors, for example in order to create a desired patterns of suction and/or modify the interface. Additionally or alternatively, the adjustment may be to cycle through a series of parameter variations that are preprogrammed.

The tissue enlargement apparatus 10 may advantageously have the defined purpose to precisely enhance vascularity in a recipient (soft tissue) site in preparation to a tissue graft/flap through the use of non-invasive mechanical forces in an un-injured soft tissue. The generated mechanical forces can be adopted and specifically selected and/or optimized for efficient pre-conditioning or post-conditioning of the recipient site. By developing a device specifically designed to achieve this purpose in combination to clearly determining the intermittent and cyclical stimulation parameters, surgical outcomes of a high number of procedures can be enhanced and complications or negative side effects (e.g., infections, partial/total graft/flap loss, prolonged hospitalization, need for more invasive or multiple surgeries, etc.) for patients can be limited.

Thus, given the incremental burden of social and economic costs related to invasive surgery and hospitalization, the disclosed tissue enlargement apparatus may be utilized in health care for non-invasive or less-invasive tissue reconstruction or enlargement in a wide arrange of disorders, and potentially organ replacement. Secondary economic gains may result from reduced hospital stays and medical care for surgical patients.

The present invention has been described in terms of one or more preferred embodiments, and it should be appreciated that many equivalents, alternatives, variations, and modifications, aside from those expressly stated, are possible and within the scope of the invention.

The invention claimed is:

1. A tissue enlargement apparatus for promoting angiogenesis and adipogenesis in soft tissue, the tissue enlargement apparatus comprising:

an interface configured for affixation to the soft tissue;

a force generating device coupled to the interface by a connecting tube for applying mechanical forces to the soft tissue;

a processor coupled to the force generating device and configured to apply intermittent cyclical patterns of the mechanical forces to the soft tissue to promote angiogenesis and adipogenesis in the soft tissue that includes predetermined off-suction or reduced-suction periods and on-suction periods designed to extend over predetermined duration or number of sessions; and a sensor configured to provide signals to the processor to detect a change in oxyhemoglobin and deoxyhemoglobin;

wherein the processor is further configured to detect whether the change of oxyhemoglobin or deoxyhemoglobin is below a predetermined threshold and adjust at least one of the mechanical forces and the intermittent cyclical patterns when the change of oxyhemoglobin or deoxyhemoglobin is below the predetermined threshold; and wherein the intermittent cyclical patterns are based on at least one of duration, frequency, and intensity of the mechanical forces and include on-suction periods of between 10 minutes and 4 hours and off-suction or reduced-suction periods of between 10 minutes and 24 hours.

2. The tissue enlargement apparatus of claim 1, wherein the interface is characterized by at least one a concave-shaped, a dome-shaped, a cup-shaped, and a sponge-shaped structure.

3. The tissue enlargement apparatus of claim 2, wherein the sponge-shaped structure interface includes a plurality of pores positioned thereon to match morphological characteristics of the soft tissue based on finite element modeling carried out by the processor to predict mechanical response of the soft tissue.

4. The tissue enlargement apparatus of claim 1, wherein the interface is constructed from at least one of a polymeric and metallic material.

5. The tissue enlargement apparatus of claim 1, wherein the mechanical forces applied to the soft tissue by the force generating device are suction forces between 10 mmHg and 125 mmHg.

6. The tissue enlargement apparatus of claim 1, further comprising at least one of a pressure sensor, a biosensor, and a piezoelectric gauge for monitoring a micro-environment of the soft tissue.

7. The tissue enlargement apparatus of claim 6, wherein the piezoelectric gauge is configured to measure at least one of temperature of the soft tissue, perfusion of the soft tissue, $pO_2$ of the soft tissue, and $pCO_2$ of the soft tissue.

8. The tissue enlargement apparatus of claim 1, wherein the interface is affixed to the soft tissue using at least one of flexible laces and adhesive dressings to seal the interface to the soft tissue.

9. The tissue enlargement apparatus of claim 1, further comprising a drug release system controlled and monitored by the processor and configured to release drugs over preprogrammed times to the soft tissue.

10. The tissue enlargement apparatus of claim 1, wherein the processor is configured to apply at least one of finite element analysis and finite element modeling to analyze how the mechanical forces are distributed on the soft tissue based on mechanical properties of the soft tissue to exploit a mitogenic pathway for improved angiogenesis and adipogenesis.

11. The tissue enlargement apparatus of claim 1, wherein the intermittent cyclical patterns of the mechanical forces are based on at least one of a ratio between the off-suction or reduced-suction periods and on-suction periods varying between 1 hour/30 minutes and 4 hours/60 minutes, a number of daily stimulations between 3 and 6, a total number of hours of stimulation daily being less than 6, an overall duration of treatment between 5 and 18 days, a pattern including 6 daily stimulations of 30 minutes each followed by 1 hour breaks each for 5-9 days of treatment to induce angiogenesis, and stimulation patterns carried out with daily to every second day frequency to induce adipogenesis.

12. A method for promoting angiogenesis and adipogenesis in soft tissue, the method comprising the steps of:

a) affixing an interface to the soft tissue;

b) providing a processor in communication with a force generating device and a sensor, the processor being configured to control the force generating device and receive input data from the sensor;

c) applying mechanical forces to the soft tissue through the interface using the force generating device coupled thereto;

d) applying intermittent cyclical patterns of the mechanical forces to the soft tissue;

e) monitoring a micro-environment of the soft tissue using the sensor to generate input data including changes in oxyhemoglobin and deoxyhemoglobin to determine whether the intermittent cyclical patterns of the mechanical forces are selected for promoting angiogenesis and adipogenesis in the soft tissue;

f) analyzing, using the processor and the generated input data, how the mechanical forces are distributed on the soft tissue when the change in oxyhemoglobin or deoxyhemoglobin is below a predetermined threshold; and e) adjusting at least one of the mechanical forces and the intermittent cyclical patterns to raise the change in oxyhemoglobin or deoxyhemoglobin above the predetermined threshold, wherein applying the mechanical forces to the soft tissue by the force generating device includes providing suction forces and the intermittent cyclical patterns includes on-suction periods of between 10 minutes and 4 hours and off-suction or reduced-suction periods of between 10 minutes and 24 hours.

13. The method of claim 12, wherein the interface is characterized by at least one a concave-shaped, a dome-shaped, a cup-shaped, and a sponge-shaped structure.

14. The method of claim 13, further comprising the step of matching morphological characteristics of the soft tissue based on modeling to predict a mechanical response of the soft tissue by providing a plurality of pores on the sponge-shaped structure interface.

15. The method of claim 12, wherein applying the mechanical forces to the soft tissue by the force generating device includes providing the suction forces between 10 mmHg and 125 mmHg to the soft tissue.

16. The method of claim 12, further comprising monitoring the micro-environment of the soft tissue with an additional sensor configured as at least one of a pressure sensor, a biosensor, and a piezoelectric gauge.

17. The method of claim 16, further comprising the step of measuring at least one of temperature of the soft tissue, perfusion of the soft tissue, $pO_2$ of the soft tissue, and $pCO_2$ of the soft tissue using the piezoelectric gauge.

18. The method of claim 12, wherein affixing the interface to the soft tissue includes using at least one of flexible laces and adhesive dressings to seal the interface to the soft tissue.

19. The method of claim 12, further comprising the step of implementing a drug release system controlled and monitored by the processor and configured to release drugs over preprogrammed times to the soft tissue.

20. The method of claim 12, wherein the intermittent cyclical patterns are based on at least one of a ratio between off suction and on suction varying between 1 hour/30 minutes and 4 hours/60 minutes, a number of daily stimulations between 3 and 6, a total number of hours of stimulation daily being less than 6, an overall duration of treatment between 5 and 18 days, a pattern including 6 daily stimulations of 30 minutes each followed by 1 hour breaks each for 5-9 days of treatment to induce angiogenesis, and stimulation patterns carried out with daily to every second day frequency to induce adipogenesis.

* * * * *